US005813119A

United States Patent [19]

Ferraro et al.

[11] Patent Number: 5,813,119

[45] Date of Patent: Sep. 29, 1998

[54] RAZORS WHICH ACTIVELY FLEX A RAZOR HEAD IN RESPONSE TO SHAVING FORCES

[75] Inventors: Frank Anthony Ferraro, Trumbull, Conn.; Ernest Albert Ortiz, Chapel Hill, N.C.

[73] Assignee: Warner-Lambert Company, Morris Plains, N.J.

[21] Appl. No.: 785,475

[22] Filed: Jan. 17, 1997

[51] Int. Cl.[6] ..... B26B 21/22

[52] U.S. Cl. ..... 30/49; 30/50; 30/532

[58] Field of Search ..... 30/48–50, 532, 30/533

[56] References Cited

U.S. PATENT DOCUMENTS 4,459,744 7/1984 Esnard .

4,754,548 7/1988 Solow .

5,333,383 8/1994 Ferraro et al. ..... 30/50 X

*Primary Examiner*—Douglas D. Watts

*Attorney, Agent, or Firm*—Charles W. Almer, III

[57] ABSTRACT

A razor which actively flexes at least one, and preferably a plurality of skin-engaging elements during shaving to follow the contours of a skin surface. One preferred razor comprises a support and a pair of rotating pivots movably connected to the support. Each rotating pivot contacts separate portions of a razor head. Shaving forces exerted on a first razor head portion in a first direction will cause the rotating pivot to move a second razor head portion in a second direction which is different from the first direction. The razor also comprises means for biasing the rotating pivots to a neutral position. In one embodiment, the support comprises a pivot assembly to which the rotating pivots are connected thereby providing another degree of movement to the rotating pivots relative to the support.

31 Claims, 16 Drawing Sheets

RAZORS WHICH ACTIVELY FLEX A RAZOR HEAD IN RESPONSE TO SHAVING FORCES

The present invention is directed to razors, and more particularly, to razors which actively flex at least one skin-engaging element concavely and convexly during shaving to follow the contours of a skin surface.

BACKGROUND OF THE INVENTION

Shaving systems such as safety razors have found widespread use for providing close and comfortable shaves. Safety razors traditionally included one or two blades disposed between a rigid guard and a rigid cap. Each of these elements was typically rigidly fixed relative to one another and disposed in skin-engaging contact during shaving. Straight, rigid blade constructions can create an imbalance of shaving forces between the blade edge and a curved skin surface.

It would, therefore, be desirable to provide a shaving system whereby a razor head would conform to and follow more closely the contours of a skin surface during shaving. Such a system would reduce the likelihood of nicks and cuts, as well as distribute the cutting forces across the length of the blade edge of the razor head so that each stroke is more efficient. As used herein, the term "razor head" is meant to include cartridges adapted to be connected to a separate razor as well as the operative cutting portion of a disposable razor wherein the handle and cutting portion are formed as a unit.

SUMMARY OF THE INVENTION

Various embodiments of the present invention provide razors for use in flexing a razor head concavely and convexly in which the razor comprises a support, and at least one rotating pivot movably connected to the support and disposed for contacting portions of a razor head. The rotating pivot rotates and slides back and forth from a neutral position to a first position, a second position or anywhere in between, whereby force exerted on a first razor head portion in a first direction will cause the rotating pivot to move a second razor head portion in a second direction which is different from the first direction.

Preferred embodiments of the present invention provide a razor which actively flexes at least one skin-engaging element, and most preferably a razor head, in response to shaving forces and skin contours. As used herein, the term "actively flex" is used to indicate that a force exerted on one portion of a skin-engaging element in a first direction causes another portion of that skin-engaging portion to move in a different direction. The rotating pivot is operable to move reactively to the contour resulting from the razor head which is conforming to the contours of the skin in either a convex or concave condition.

Other embodiments of the present invention provide razors which comprise a support and a pair of rotating pivots movably connected to the support and disposed for contacting portions of a razor head, and desirably comprises means for biasing the rotating pivots to a neutral position between the first position and the second position.

Still other embodiments of the present invention provide razors which comprise a support, and a pair of rotating pivots movably connected to the support via a pivoting assembly to permit an additional degree of motion of a razor head relative to the razor.

These and other embodiments of the present invention are described below.

BRIEF DESCRIPTION OF THE DRAWINGS

FIGS. 2A–2C are top views of the shaving system shown in FIG. 1 in which the razor head is shown in phantom, and wherein FIG. 2A illustrates the razor head unflexed, FIG. 2B illustrates the razor head undergoing a convex flex, and FIG. 2C illustrates the razor head undergoing a concave flex.

DETAILED DESCRIPTION

Embodiments of the present invention provide razors which are operable to actively flex a skin-engaging element concavely and convexly in response to shaving forces exerted on at least one skin-engaging element to conform the skin-engaging element to curved skin surfaces during shaving.

Figure 1:
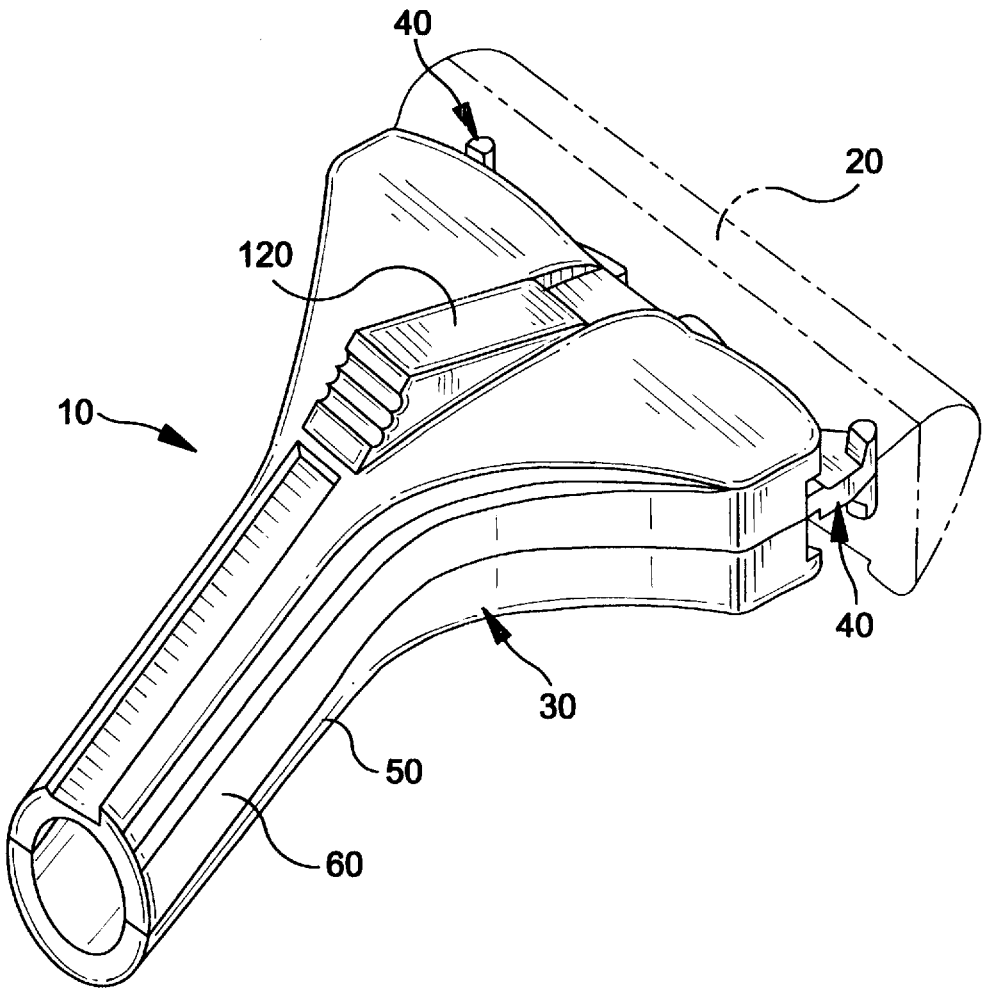
FIG. 1 is a perspective view of one embodiment of a shaving system according to the present invention.

FIG. 1 illustrates one embodiment of a razor 10 according to the present invention which is configured to releasably connect to a razor head 20 and is operable to actively flex razor head 20 concavely and convexly in response to shaving forces and skin contour. In this illustrated embodiment, razor 10 comprises a support 30 and a pair of rotating pivots 40 which releasably attach to opposite longitudinal portions of razor head 20.

Figure 2A:
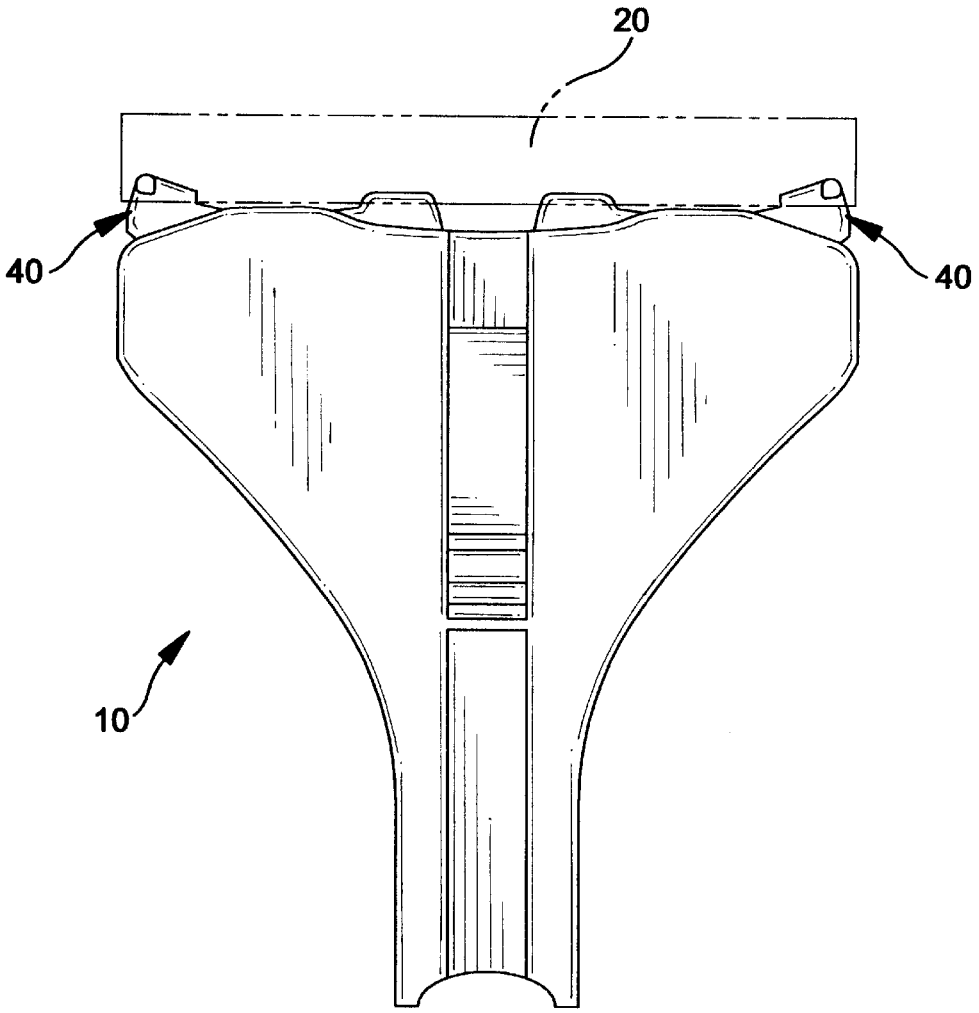
Figure 2C:
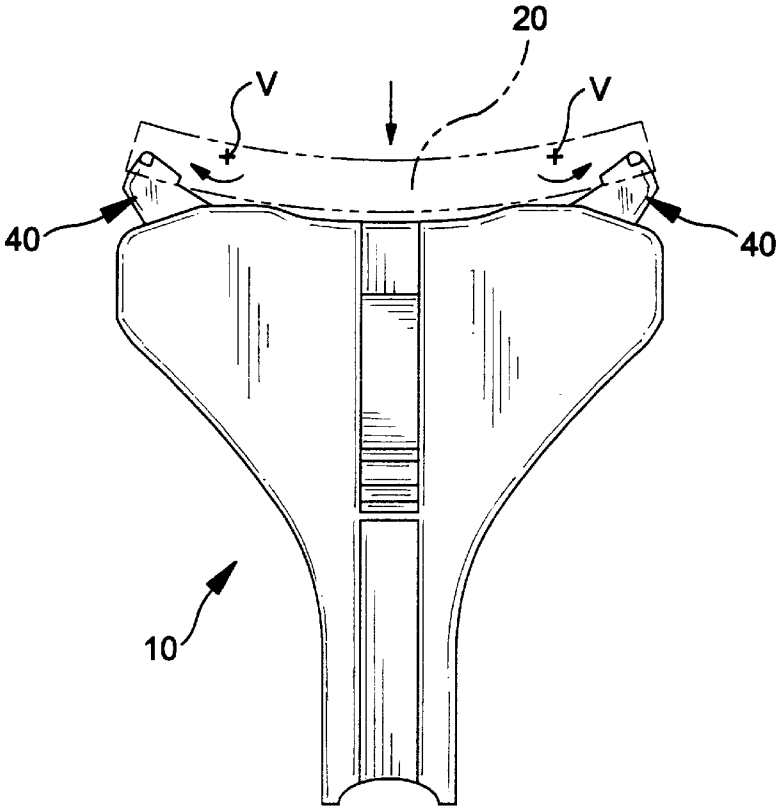
Figure 2B:
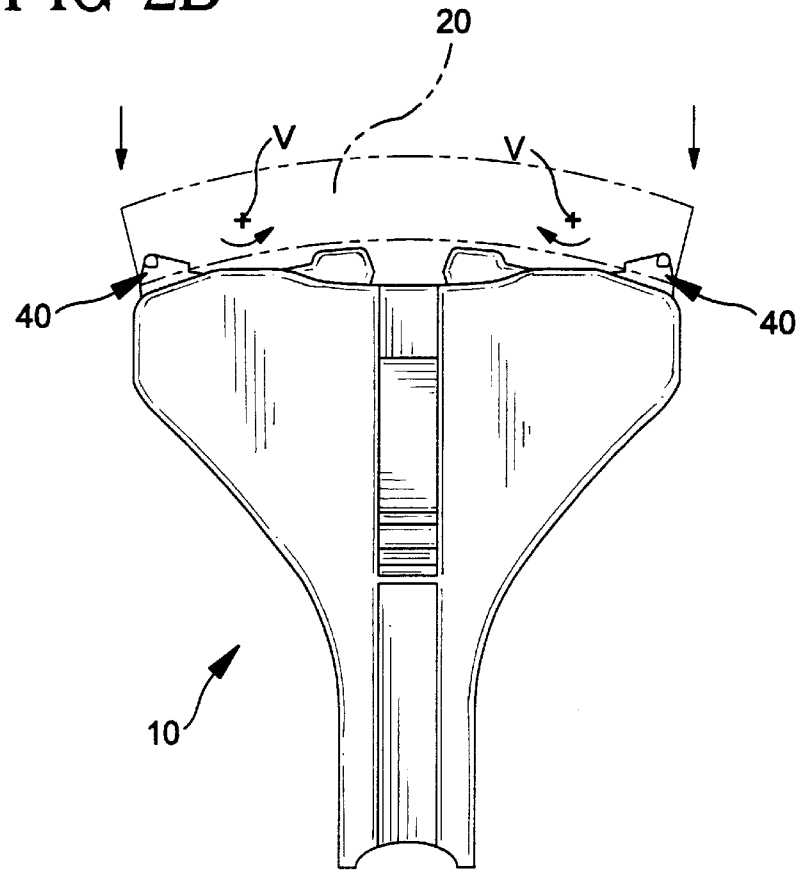
Figure 3:
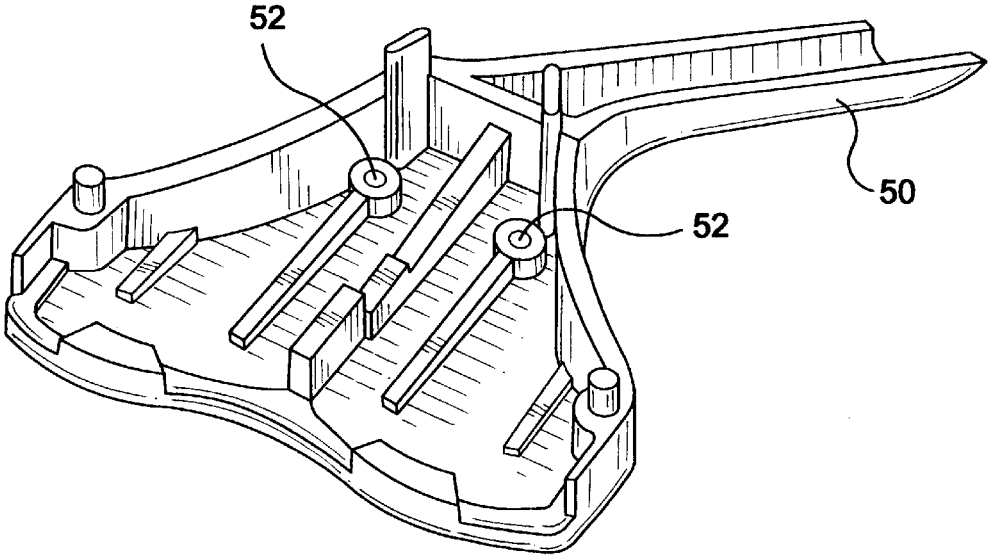
FIG. 3 is a perspective view of the lower frame member of the razor shown in FIG. 1, illustrating the inside thereof.

As shown in FIG. 2A and as will be explained in greater detail below, each rotating pivot 40 of razor 10 is biased toward an equilibrium position, e.g., toward a position where razor head 20 (shown in dashed lines) is essentially disposed in a straight and unflexed configuration. In addition, as further shown in FIGS. 2B and 2C, each rotating pivot 40 is also operable to actively flexing razor head 20 (shown in dashed lines) in response to shaving forces and skin contour. In particular, when shaving forces are exerted on the outer end portions of razor head 20, e.g., when shaving underarms, as illustrated in FIG. 2B, rotating pivots 40 pivot in the direction of the curved arrows about virtual pivot points V to impart a convex flex to razor head 20. When shaving forces are exerted on a central portion of razor head 20, e.g., when shaving a shin, as illustrated in FIG. 2C, rotating pivots 40 pivot in the direction of the curved arrows about virtual pivot points V to impart a concave flex to razor head 20. As such, the movement of the skin-engaging elements of this illustrated embodiment of the present invention differs from that of generally rigid blades which may deflect vertically or angularly in response to shaving forces, and from that of flexible blades which exhibit simple downward flexing about their end portions.

Figure 5:
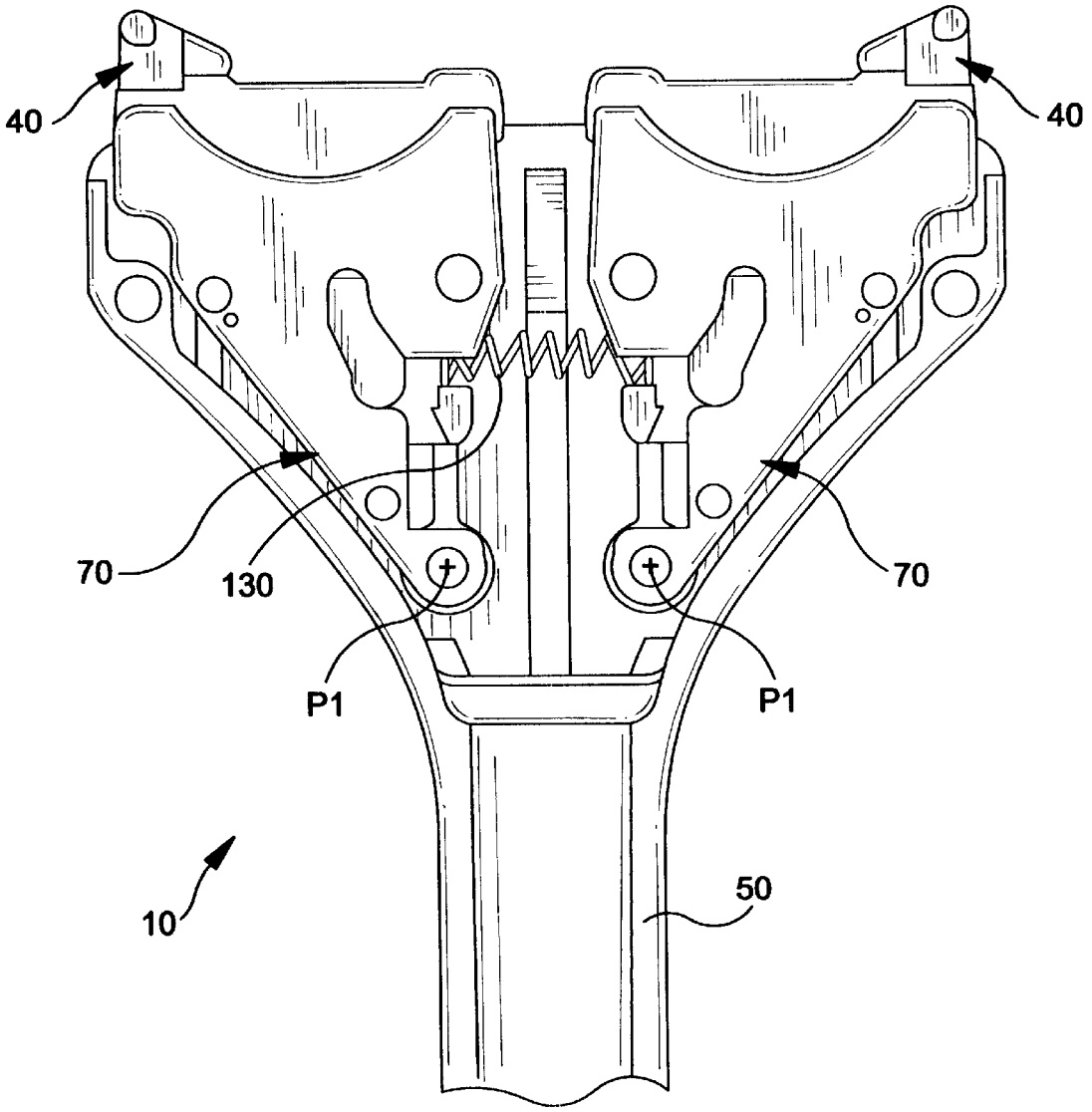
FIG. 5 is a top view of the shaving system shown in FIG. 1 with the upper frame member and actuator removed to illustrate the inside of the razor.

With reference again to FIG. 1, the illustrated support 30 comprises a lower frame 50, an upper frame 60, and an actuator 120. As shown in FIG. 5, a pair of modules 70 are disposed partially between the frames. Each module is pivotally connected to lower frame 50 and upper frame 60 at points P1 and comprises a rotating pivot 40 for selectively engaging razor head 20. Advantageously, modules 70 are configured to be essentially the same and interchangeable, and thus, positionable on either side of razor 10. Those skilled in the art will appreciate that forming module 70 to be interchangeable substantially reduces the cost associated with manufacturing the razor by reducing the number of different parts and the associated required tooling.

Figure 6:
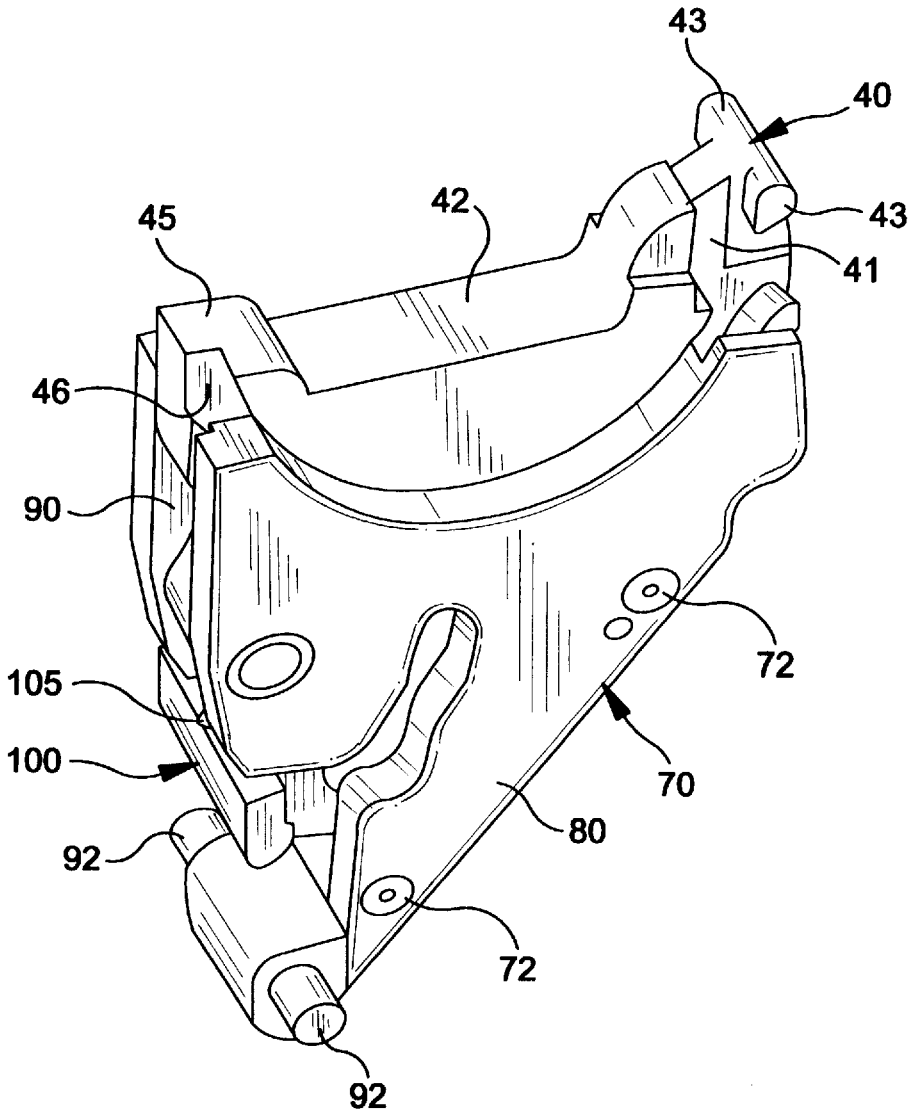
FIG. 6 is an enlarged perspective view of the module shown in FIG. 5.

As shown in FIGS. 6 and 7, each illustrated module 70 comprises a front cover 80, a rear cover 90, a rotating pivot 40, and a pivot return 100 pivotally connected to and disposed between the covers which operably biases rotating pivot 40 to a neutral position. While the illustrated modules 70 are held together by screws 72, those skilled in the art will appreciate that other fastening means can be utilized without departing from the scope of the present invention. One preferred embodiment comprises a module with a molded, one piece shell. Rotating pivot and pivot return can be snap fit into the molded shell.

The illustrated embodiment of rotating pivot 40 comprises an upper portion 42 which is connectable with razor head 20 (not shown in FIGS. 6 and 7), and a lower portion 44 disposed in sliding engagement with the module. The illustrated upper portion 42 comprises a razor head engaging portion 41 having a pair of outwardly extending tabs 43 which operably engage a razor head. Upper portion 42 also comprises an inner engaging face 45 spaced from razor head engaging portion 41. Razor head engaging portion 41 of rotating pivot 40 is engageable with the outer end portions of razor head 20 while inner engaging face 45 contacts a bottom surface of razor head 20 closer to the central portion of razor head 20.

Figure 7A:
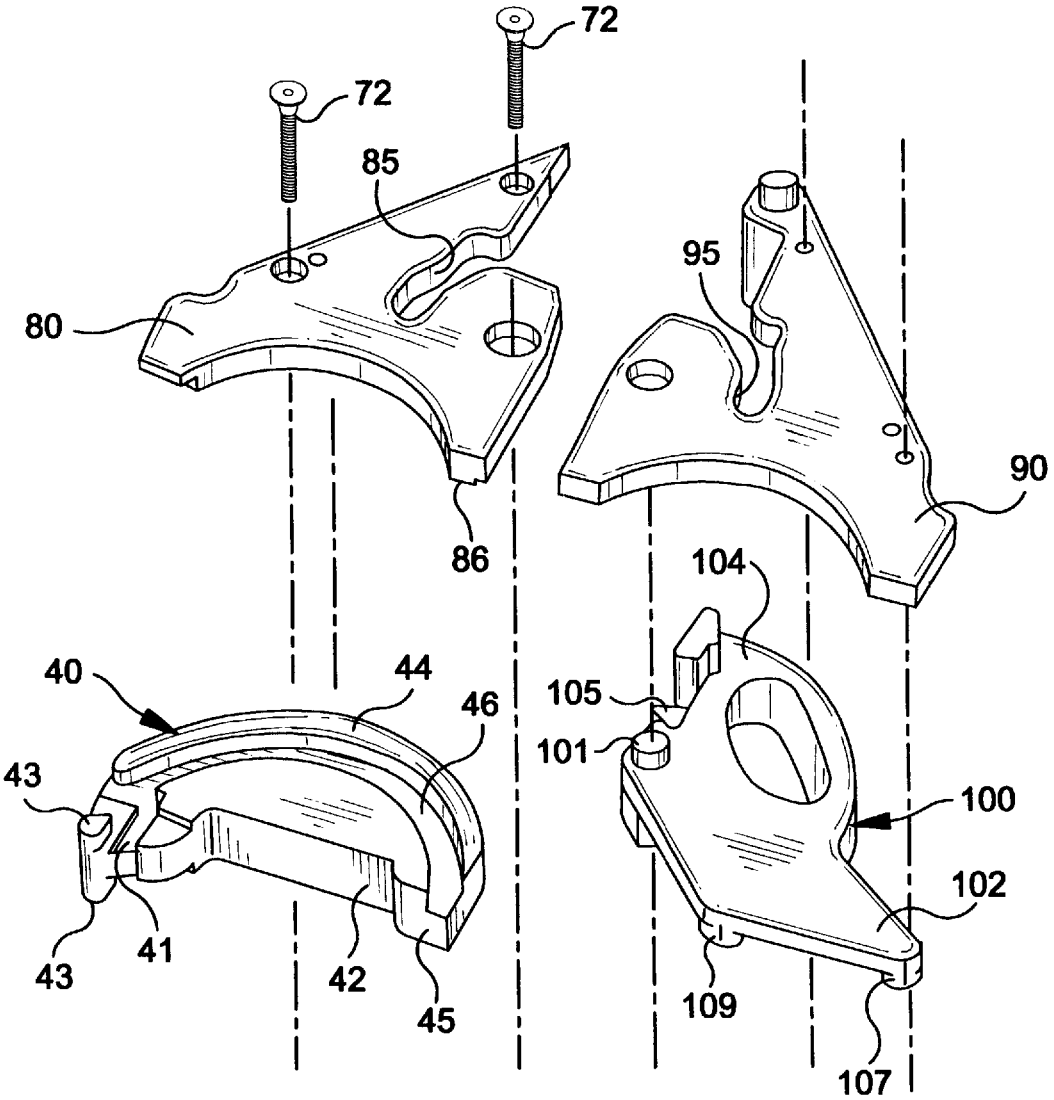
FIGS. 7A and FIG. 7B are exploded perspective views of the module shown in FIG. 6.

As shown in the bottom left of FIG. 7A, the lower portion 44 of rotating pivot 40 comprises a first side having a curved slot 46 which is guided by a curved raised rim 86 on cover 80. The curved, raised rim 86 of cover 80 is best shown in the lower right of FIG. 7B.

Figure 7B:
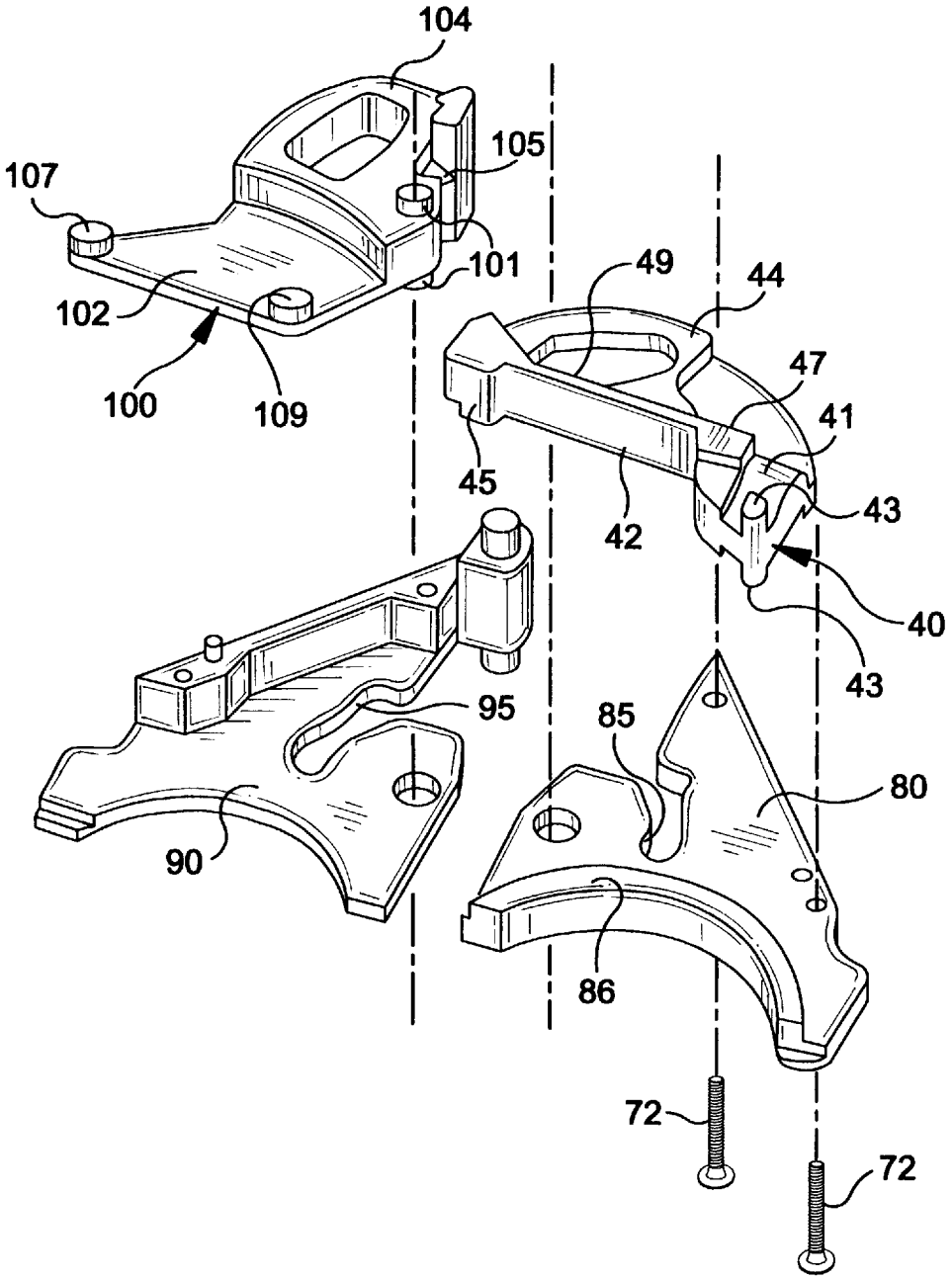

A second side of lower portion 44 of rotating pivot 40 shown in the upper right of FIG. 7B comprises a first cam 47 positioned generally below razor head engaging portion 41 and a second cam surface 49 disposed adjacent inner engaging face 45. Cam surfaces 47 and 49 of rotating pivot 40 cooperate with pivot return 100, as explained below, to bias rotating pivot 40 back to a neutral position.

Tabs 101 thereby form a pivoting axis for pivot return 100. A spring 130 is positioned on opposing spring pins 105 of the two pivot returns 100 in order to bias the spring pins 105 outwardly. This generally outward biasing force on spring pins 105 is translated into a generally upwardly directed force on a first tab 107 and second tab 109. Tab 107 and tab 109 operably engage cam surfaces 47 and 49, respectively, of rotating pivot 40 to bias rotating pivot 40 toward a neutral position. This novel arrangement accomplishes the return of rotating pivots 40 from either a convex or concave position utilizing a single biasing spring 130 due to the positioning of both of tabs 107 and 109 on the same side of the pivoting axis formed by pins 101 of pivot return 100, and the opposite cam surfaces 47 and 49 of rotating pivot 40.

Figure 8A:
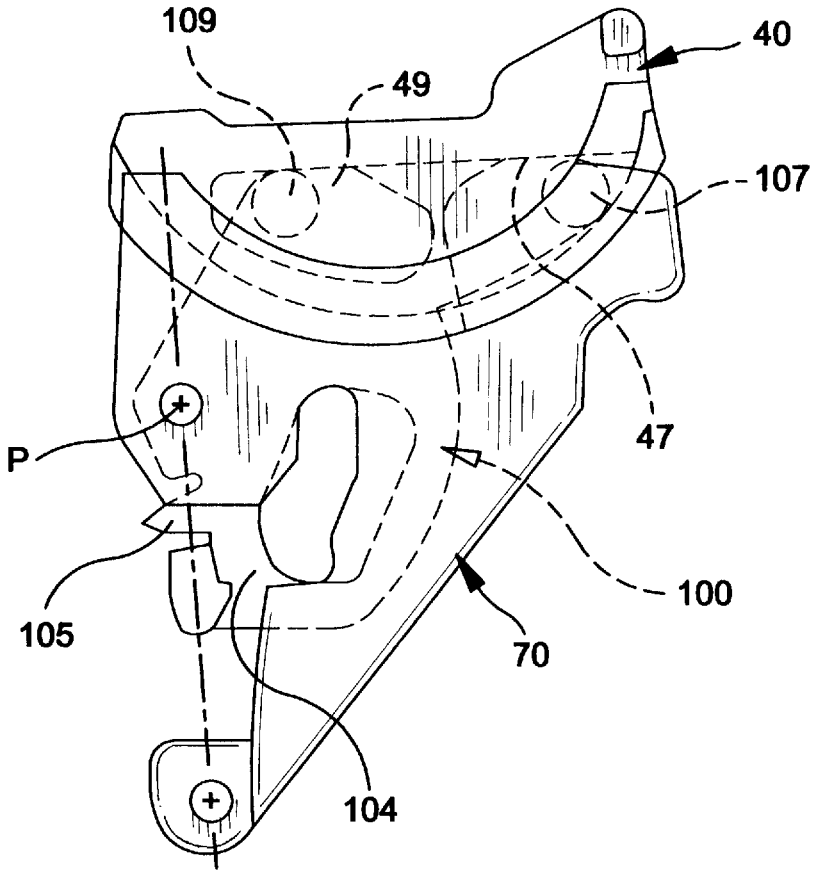
FIG. 8A is a top view of the module shown in FIG. 2 in which the rotating pivot is in a neutral position.
Figure 8C:
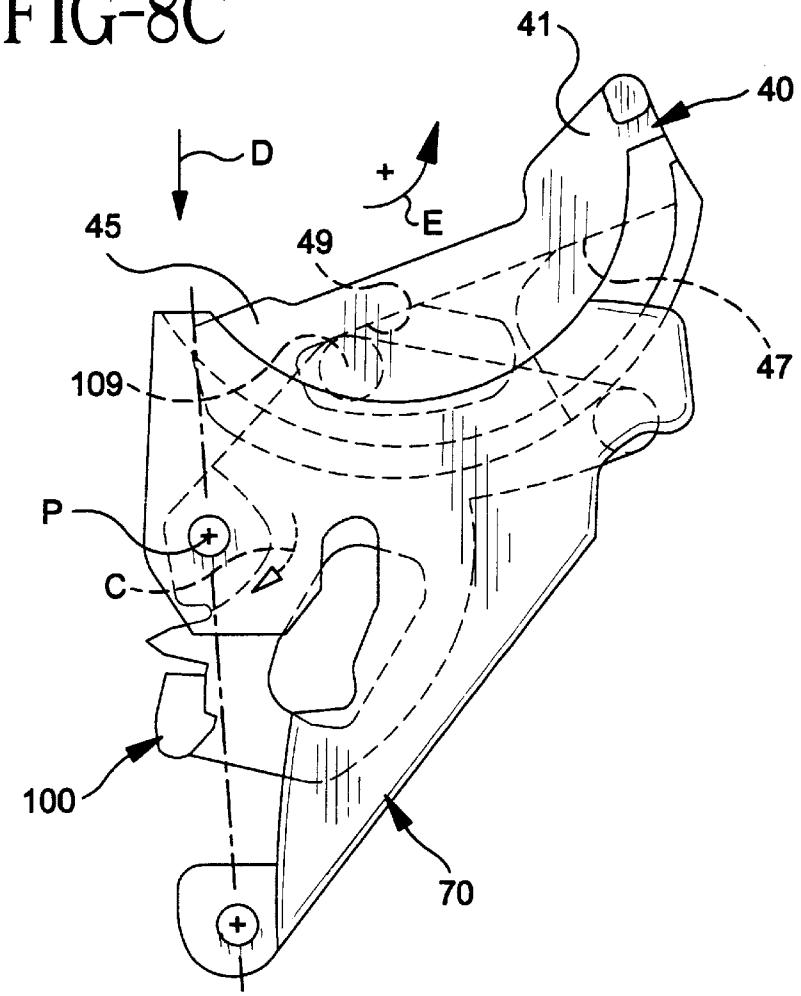
FIG. 8C is a top view of the module and similar to FIG. 5 wherein the rotating pivot is disposed in a second position.
Figure 8B:
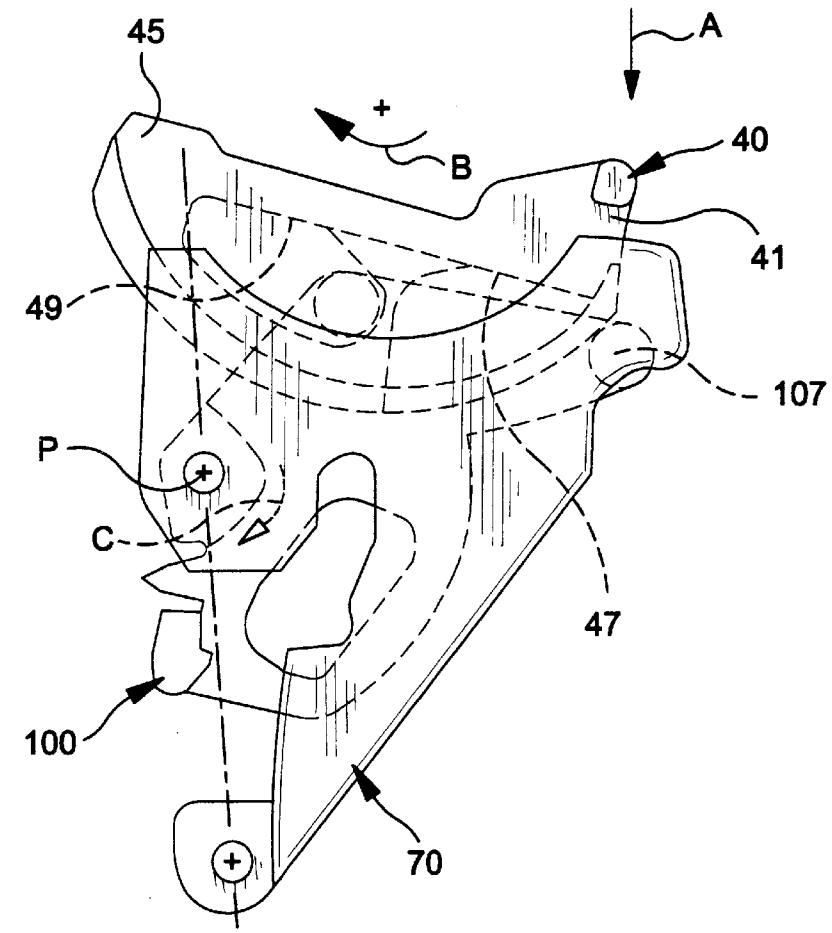
FIG. 8B is a top view of the module similar to FIG. 5 wherein the rotating pivot is disposed in a first position.

FIGS. 8A–8C illustrate the interaction between the motion of rotating pivot 40 and the pivoting motion of pivot return 100. In particular, FIG. 8A illustrates rotating pivot 40 disposed in a neutral position, e.g., wherein a razor head is disposed in a unflexed position. In this neutral position, raised tabs 107 and 109 are disposed along the top surface of cam surfaces 47 and 49, respectively. As shown in FIG. 8B, when a shaving force is applied to razor head engaging portion 41 of rotating pivot 40, e.g., a force applied in the direction of arrow A, rotating pivot 40 is rotated in the direction of curved arrow B. This causes cam surface 47 to deflect raised tab 107 downwardly and pivot return 100 to rotate about point P in the direction of curved arrow C. Simultaneously, cam surface 49 moves upwardly away from tab 109. As shown in FIG. 8C, when a shaving force is applied to inner engaging surface 45 of rotating pivot 40, e.g., force applied in the direction of arrow D, rotating pivot 40 is rotated in the direction of curved arrow E which causes cam surface 49 to deflect raised tab 109 downwardly. This causes pivot return 100 to also rotate about point P in the direction of curved arrow C.

As shown in FIG. 8A, pivot return 100 comprises a conically-shaped spring pin 105 which extends inwardly from a portion of pivot return below pivot axis P. A spring 130, as shown in FIG. 5, spans between adjacent modules 70 with each end of spring 130 engaging a respective spring pin 105. The outwardly directed forces of spring 130 bias both tabs 107 and 109 upwardly. When the shaving forces are removed from the razor head, there will be an imbalance of forces on tabs 107 and 109. These tabs will then move upwardly until both tabs are in contact with their respective cam surfaces. In this manner, pivot return 100 restores rotating pivot 40 to the neutral position shown in FIG. 8A.

Figure 9:
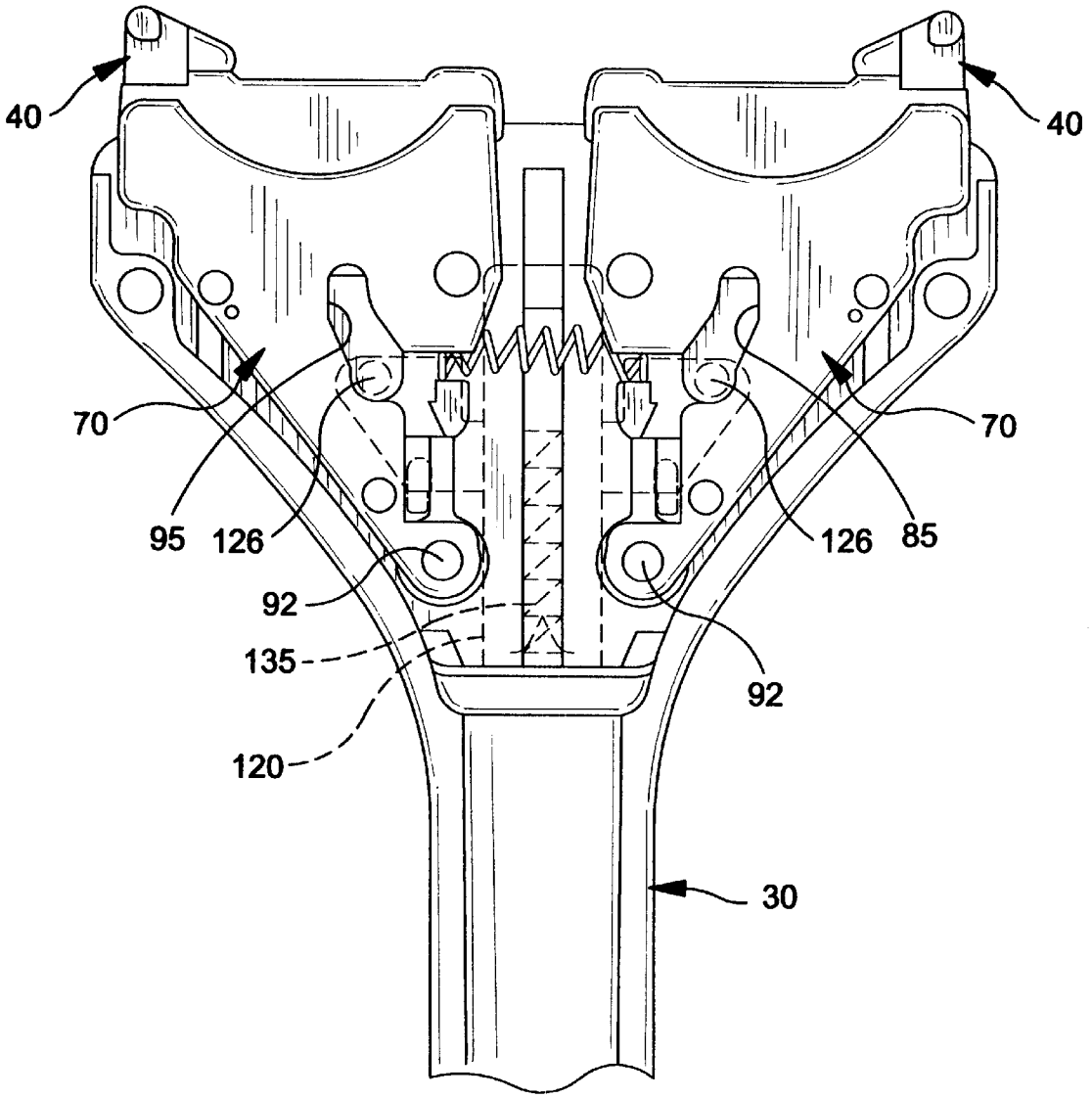
FIG. 9 is a top view of the shaving system shown in FIG. 1 with the upper frame member removed and the actuator shown in dashed lines.
Figure 10:
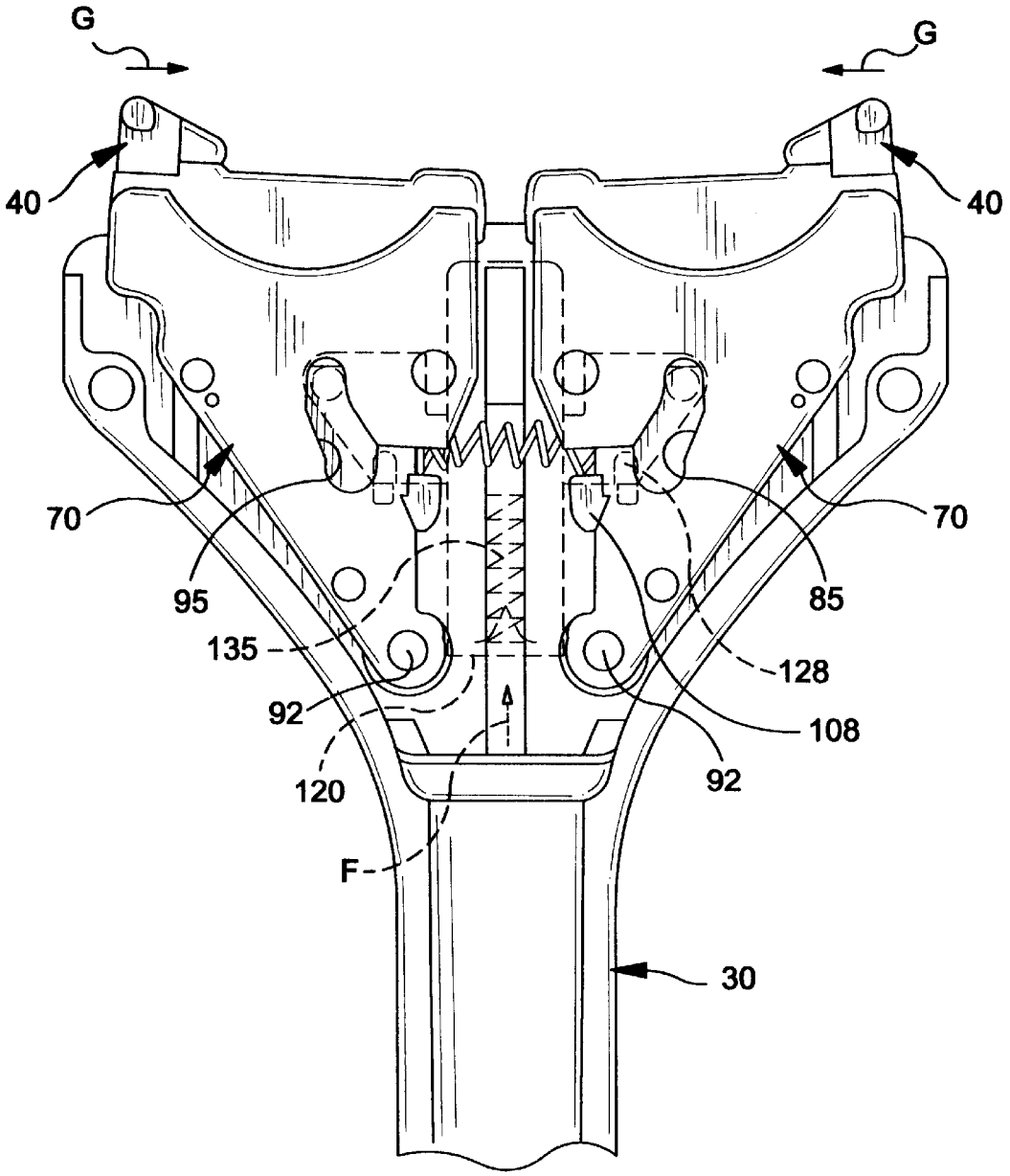
FIG. 10 is a top view of the shaving system shown in FIG. 1 with the upper frame removed and the modules in the locked position.

With reference to FIGS. 9–10, modules 70 are pivotally attached to support 30 so as to allow modules 70 to be pivotal toward and away from each other via operation of actuator 120 (shown in dashed lines). From the present description, those skilled in the art will appreciate that the selective inward movement of rotating pivots 40 facilitates the loading and unloading of a razor head (not shown) onto the illustrated razor. The lower portion of module 70 comprises outwardly extending tabs 92 (best shown in FIG. 6) which are pivotally receivable in aligned apertures 52 and 62 in lower frame 50 and upper frame 60, respectively.

Figure 11:
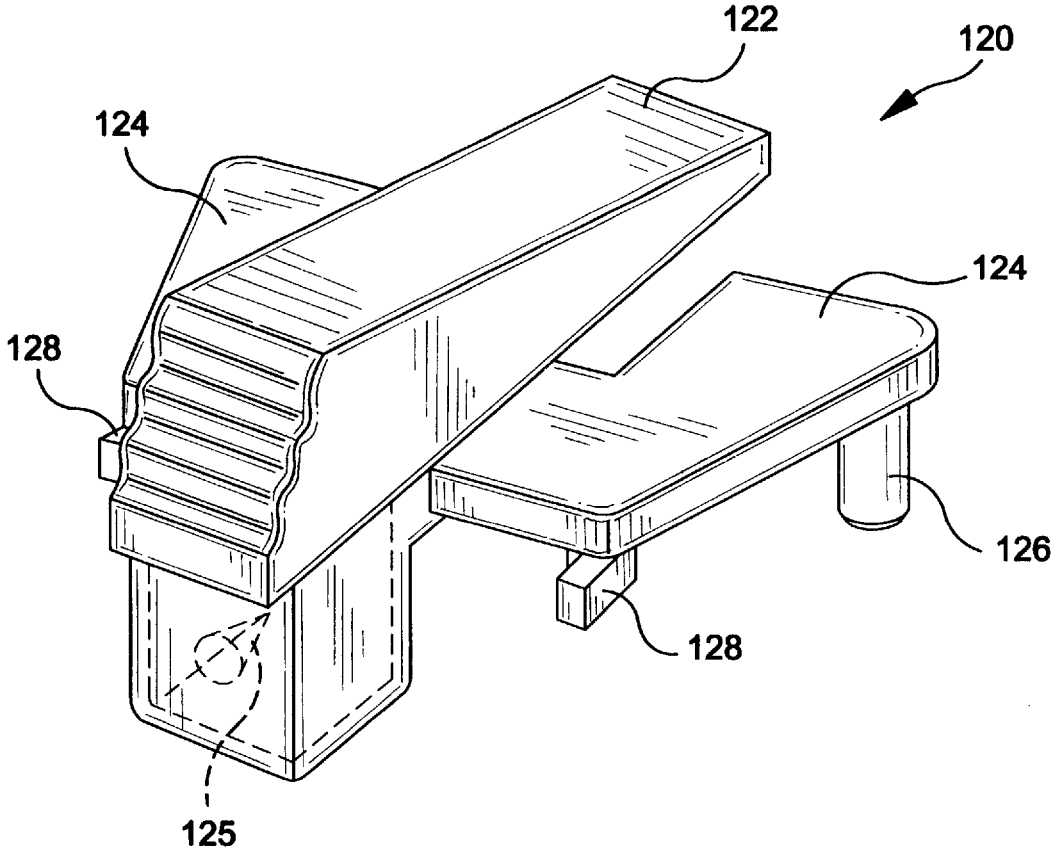
FIG. 11 is a perspective view of the actuator shown in FIG. 1.
Figure 12:
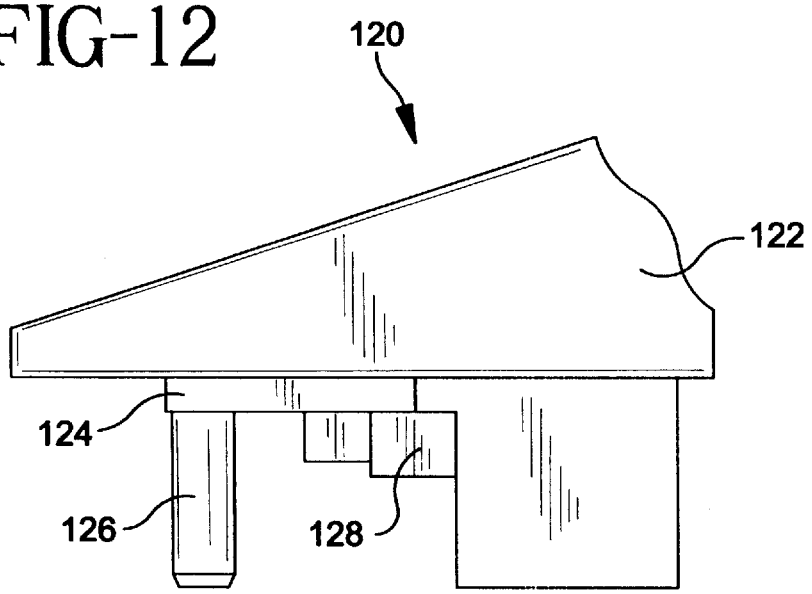
FIG. 12 is a elevational view of the actuator shown in FIG. 11.

Actuator 120, as shown in FIGS. 11 and 12, comprises a central portion 122 from which outwardly wing-like members 124 extend. Each wing-like members 124 comprises a pin 126 and a catch 128. As shown in FIG. 9, pins 126 of actuator 120 normally engage the lower, inner surfaces of cam slots 85 and 95 of module 70.

With reference to FIG. 10, as actuator 120 is moved in the direction of dashed arrow F, pins 126 move within cam slots 85, 95 and engage the inner cam surfaces to pivot the module 70 inwardly about pins 92. The razor head engaging portions of rotating pivots 40 will, therefore, move inwardly toward each other in the direction of inwardly facing arrows G.

Figure 4:
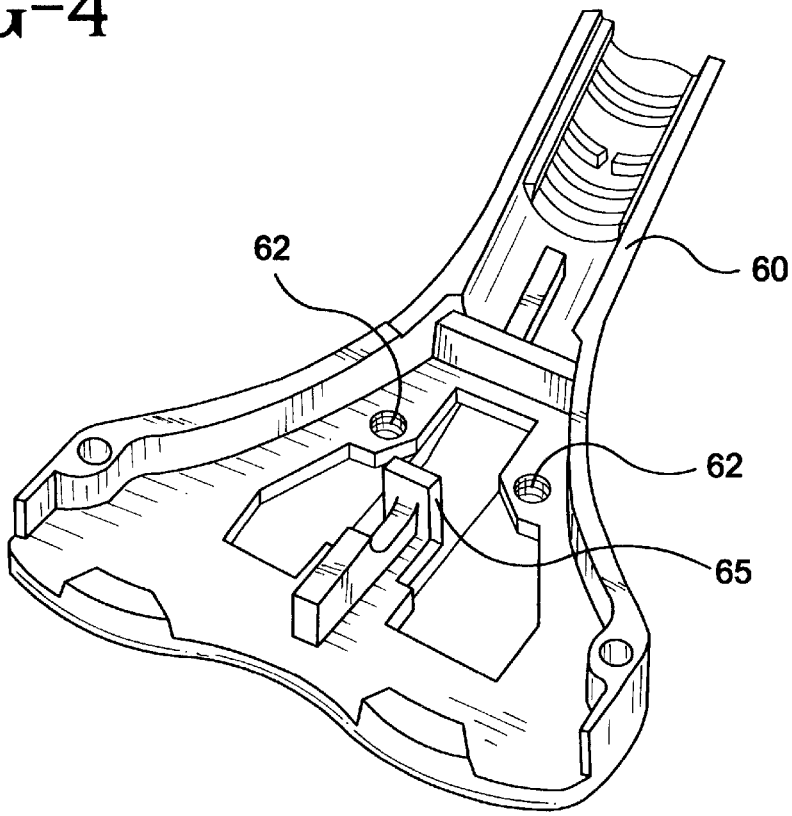
FIG. 4 is a perspective view of the upper frame member of the razor shown in FIG. 1, illustrating the inside thereof.

As pins 126 reach the upper portions of the cam slots, catch 128 of actuator 120 engages a corresponding catch 108 of pivot return 100. The temporary locking engagement of actuator catch 128 with catch 108 maintains the actuator in the upper position (illustrated in FIG. 10) against the rearwardly biasing force of spring 135. The razor head engaging portions of the rotating pivots are thereby advantageously maintained inwardly until a razor head is loaded onto the razor. This temporary locking engagement is designed to release in response to a slight depressing of engagement member 43 of the module during loading of a razor head. Once released, spring 135 disposed between a projection 65 of upper frame 60 (shown in FIG. 4) and spring tab 125 of actuator 120 (shown in FIG. 11) to bias actuator 120 toward the retracted position shown in FIG. 9.

Figure 13:
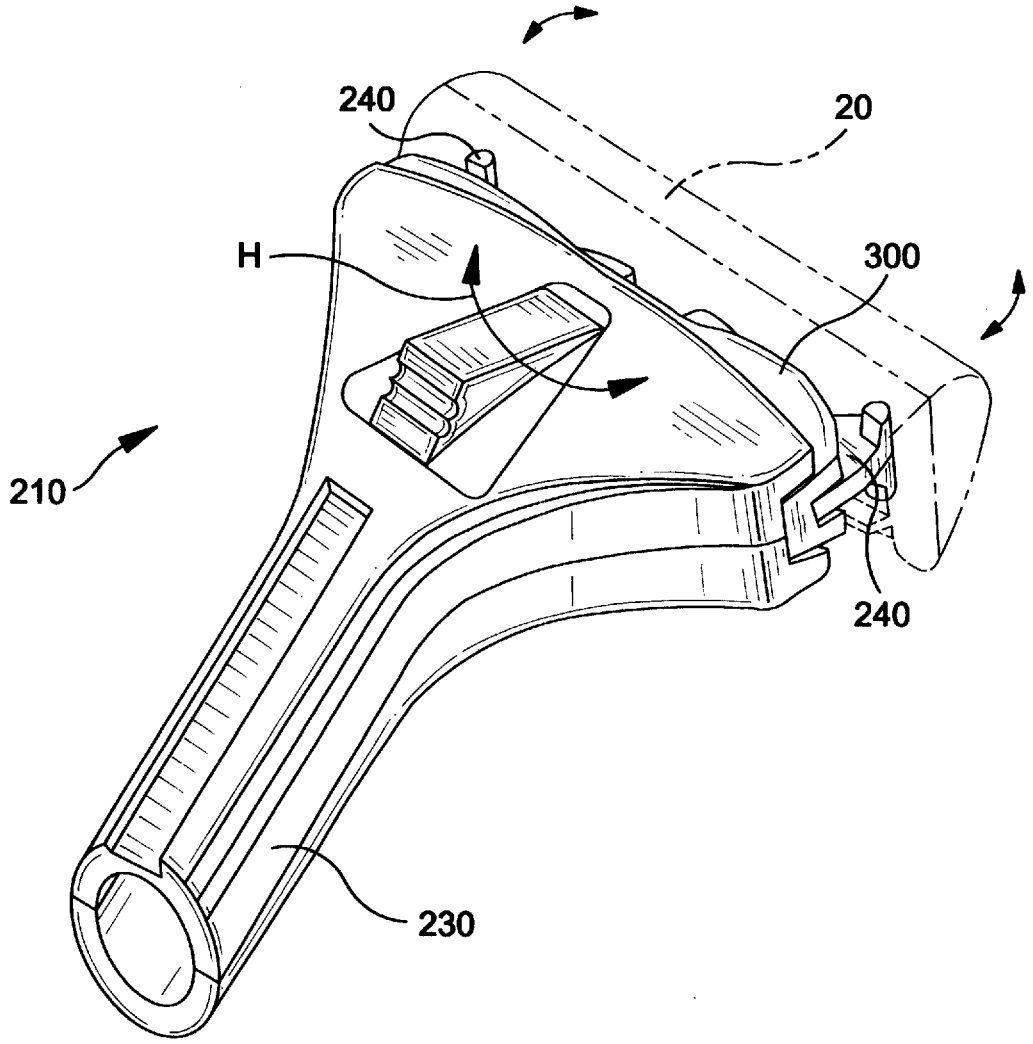
FIG. 13 is a perspective view of an alternative embodiment of the present invention which includes a pivoting assembly.
Figure 14:
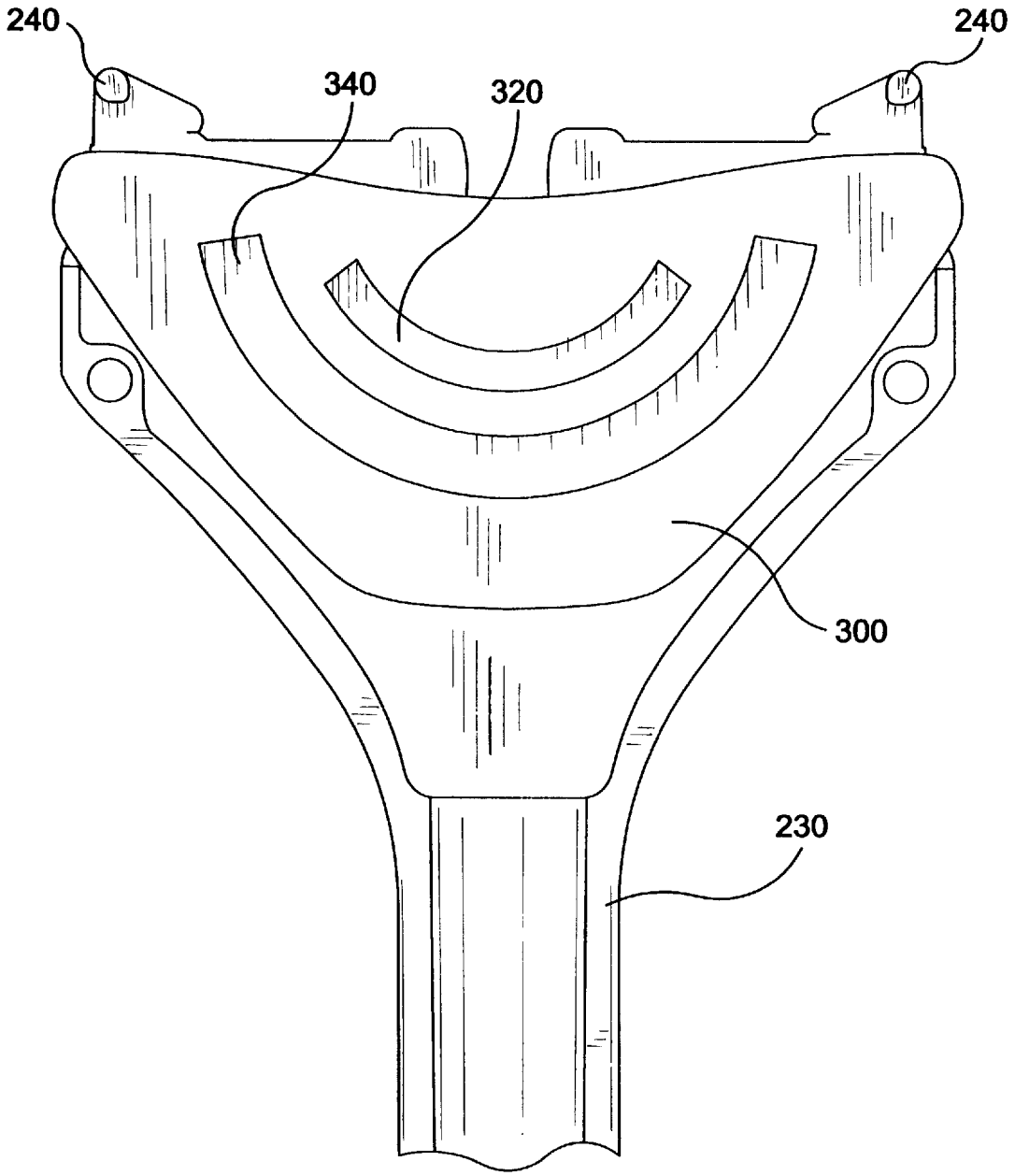
FIG. 14 is a bottom view of the shaving system shown in FIG. 13 with the bottom outer shell removed.
Figure 15:
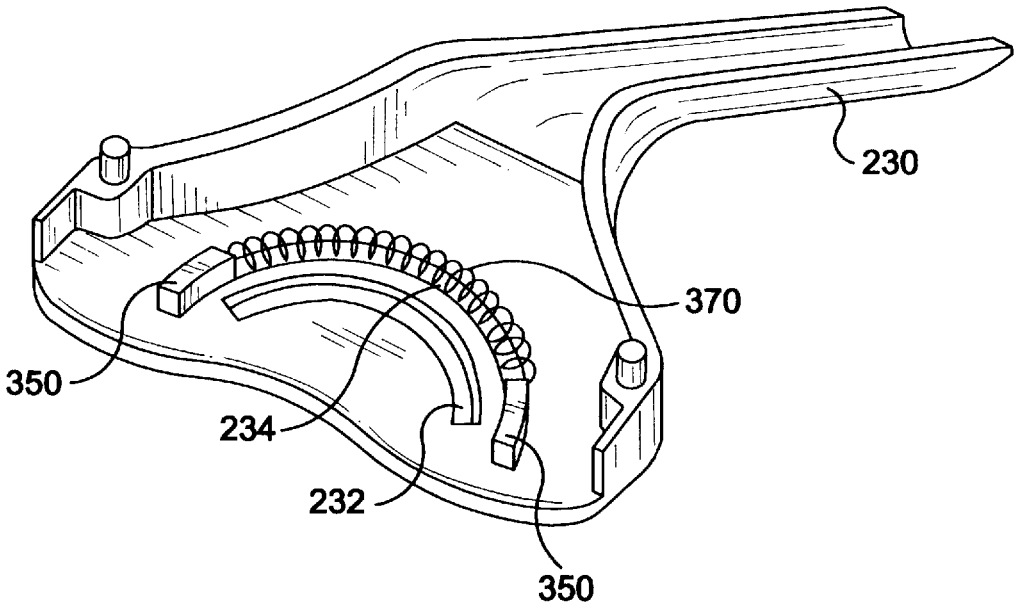
FIG. 15 is a perspective view of the bottom outer shell of the razor shown in FIG. 13, illustrating the inside thereof.

FIGS. 13–15 illustrate an alternative embodiment of the present invention which provides a razor 210 designed to provide rotating pivots 240 with an additional degree of freedom relative to support 230. Specifically, razor 210 comprises, in addition to a support 230 and a pair of rotating pivots 240 each of which releasably attaches to opposite longitudinal halves of a razor head 20, a pivoting assembly 300.

As illustrated in FIG. 14, if the shaving forces are greater on one side of a razor head, pivoting assembly 300 will pivot in the direction of curved arrow H to distribute the shaving forces.

As shown in FIGS. 14 and 15, pivoting assembly 300 provides a shell for containing and allowing rotating pivot 240 and modules (not shown) to rotate. As illustrated in FIG. 14, the bottom surface of shell 300 is provided with a raised rim 320 and a slot 340. Desirably rim 320 and slot 340 are curved and concentric.

The bottom portion of razor 230, as illustrated in FIG. 15, has a slot 232 corresponding to rim 320 (FIG. 14). The bottom portion of razor 230 also has a slot 234 corresponding to slot 340. A pair of spacers 350 and a spring 370 are disposed between slots 234 and 340 when pivot assembly 300 is contained within razor 230. Spacers 350 and spring 320 cooperate to bias pivot assembly 300 to a neutral position relative to razor 230. As pivot assembly 300 is pivoted, spring 370 is compressed and then operates to bias pivot assembly back to a neutral position when the shaving forces are removed.

Preferably, the various components of the illustrated razors are fabricated by injection molding utilizing suitable materials, for example, nylon, acetal, ABS (acrylonitrile-butadiene-styrene), polycarbonate or combinations thereof.

From the present description it will be appreciated that the rotating pivots need not be biased to a position where a razor head is normally placed in a straight position. For example, it may be desirable to bias the rotating pivots so that a slight concave or convex flex is imparted to a razor head in the absence of external shaving forces. In addition, it will be appreciated that the rotating pivots can allow pivotal movement of a razor head relative to a razor to make the razor head self-orientating relative to the skin surface.

Also, from the present description, it will be appreciated from the present invention that while the rotating pivots move along a slot, it may be desirable to pivotally connect the rotating pivot to the module, e.g., via a pin.

From the present description, it will also be appreciated that the present invention can be utilized to actively flex one or more skin engaging elements and need not actively flex an entire razor head. For example, it may be desirable to actively flex one or more blades, a cap member and/or a guard member, without actively flexing other skin-engaging elements of a shaving system.

What is claimed is:

1. A razor for actively flexing a flexible razor head, said razor comprising:

a support; and means for actively flexing a razor head, said flexing means movably connected to said support and disposed for contacting portions of a razor head, wherein said flexing means is moveable between a first position and a second position, whereby force exerted on a first razor head portion in a first direction will cause said flexing means to rotatably move a second razor head portion in a second direction which is different from said first direction, wherein said flexing means comprises at least one rotating pivot and wherein said rotating pivot comprises a slot which guides said rotating pivot between said first and second positions.

2. A razor according to claim 1 wherein said flexing means comprises a plurality of rotating pivots.

3. A razor according to claim 1 further comprising means for returning said rotating pivot to a neutral position where said razor head is substantially straight.

4. A razor according to claim 1 wherein said rotating pivot returning means comprises a raised rim by which said slot of said rotating pivot is guided.

5. A razor according to claim 4 wherein said slot and said rim are curved.

6. A razor according to claim 1 wherein said flexing means is part of a module which is moveably connected to said support.

7. A razor according to claim 6 wherein said module comprises at least one rotating pivot and a pivot return.

8. A razor according to claim 7 wherein said module is pivotally connected to said support.

9. A razor according to claim 8 wherein said pivot return pivots in the same direction when said rotating pivot is in said first position and when said rotating pivot is in said second position.

10. A razor according to claim 8 wherein said pivot return comprises a first tab and a second tab which are engagable with portions of said rotating pivot.

11. A razor according to claim 10 wherein said rotating pivot comprises a first cam surface and a second cam surface, and wherein said first and second tabs of said pivot return engage said cam surfaces to bias said rotating pivot to a neutral position in the absence of external shaving forces.

12. A razor according to claim 7 further comprising means for biasing said pivot return into engagement with said rotating pivot.

13. A razor according to claim 1 wherein said flexing means comprises a pair of rotating pivots disposed for contacting portions of a razor head.

14. A razor according to claim 1 wherein said flexing means are portions of a pair of interchangeable modules.

15. A razor according to claim 14 wherein said modules are disposed on said support with a spring disposed between said modules to bias said flexing means to a neutral position.

16. A razor according to claim 6 comprises two modules which are pivotally connected to said support to pivot said modules toward and away from each other.

17. A razor according to claim 16 wherein said modules comprise a pin which is pivotally received in a recess in said support.

18. A razor according to claim 16 wherein said razor further comprises an actuator operable to move said modules toward and away from each other.

19. A razor according to claim 18 wherein said actuator comprises a pair of pins and said modules comprise a cam slot which receives said pins of said actuator.

20. A razor according to claim 1 further comprising means for pivoting said flexing means relative to said support.

21. A razor according to claim 1 wherein said support comprises an upper frame member and a lower frame member.

22. A razor according to claim 1 comprising a pivot assembly for containing said flexing means in said support.

23. A razor according to claim 22 wherein said pivot assembly comprises a raised rim which guides the rotation of said pivot assembly.

24. A razor according to claim 23 wherein said support comprises a slot within which said raised rim of said pivot assembly is guided.

25. A razor according to claim 22 wherein said pivot assembly is biased toward a neutral position.

26. A razor according to claim 25 comprising a spring to bias said pivot assembly toward a neutral position.

27. A module for a razor which actively flexes a flexible razor head, said module comprising:

means for contacting at least two separate portions of a razor head, said contacting means comprising at least two portions, wherein a first portion of said contacting means rotatably moves in a first direction in response to a force exerted on a second portion of said contacting means in a second direction and wherein said contacting means comprises a rotating pivot and said rotating pivot comprises a slot, said module further comprising a rim which movably engages said slot and guides said rotating pivot between a first position, a neutral position and a second position.

28. A module according to claim 27 wherein said first direction is substantially opposite to said second direction.

29. A module according to claim 27 wherein said slot is curved.

30. A module according to claim 27 wherein said rotating pivot comprises a pair of tabs for engaging a razor head.

31. A module according to claim 27 further comprising means for returning said contacting means to a neutral position.

* * * * *